US011292691B2

(12) United States Patent
Sonnenmoser et al.

(10) Patent No.: US 11,292,691 B2
(45) Date of Patent: Apr. 5, 2022

(54) MONITORING UNIT FOR AN ELEVATOR SYSTEM, AND METHOD

(71) Applicant: Inventio AG, Hergiswil (CH)

(72) Inventors: Astrid Sonnenmoser, Hochdorf (CH); Adrian Knecht, Döttingen (CH); Ivo Lustenberger, Buttisholz (CH); Kurt Heinz, Buchs (CH); Thomas Hartmann, Kleinwangen (CH)

(73) Assignee: INVENTIO AG, Hergiswil (CH)

( * ) Notice: Subject to any disclaimer, the term of this patent is extended or adjusted under 35 U.S.C. 154(b) by 997 days.

(21) Appl. No.: 15/774,024

(22) PCT Filed: Nov. 10, 2016

(86) PCT No.: PCT/EP2016/077195
§ 371 (c)(1),
(2) Date: May 7, 2018

(87) PCT Pub. No.: WO2017/081113
PCT Pub. Date: May 18, 2017

(65) Prior Publication Data

US 2018/0354747 A1 Dec. 13, 2018

(30) Foreign Application Priority Data

Nov. 12, 2015 (EP) ..... 15194347

(51) Int. Cl.
*B66B 5/00* (2006.01)
*B66B 1/28* (2006.01)
(Continued)

(52) U.S. Cl.
CPC ..... *B66B 5/0018* (2013.01); *B66B 1/28* (2013.01); *B66B 1/3407* (2013.01); *B66B 5/005* (2013.01); *B66B 5/027* (2013.01); *B66B 13/22* (2013.01)

(58) Field of Classification Search
CPC ... B66B 5/0018; B66B 5/0006; B66B 5/0031; B66B 5/021
See application file for complete search history.

(56) References Cited

U.S. PATENT DOCUMENTS 6,998,995 B2 * 2/2006 Nakajima ..... B66B 5/0006 340/686.1
2003/0052544 A1 * 3/2003 Yamamoto ..... B66B 5/0018 307/66

(Continued)

FOREIGN PATENT DOCUMENTS

CN 1290647 A 4/2001
CN 1291584 A 4/2001

(Continued)

*Primary Examiner* — Christopher Uhlir
(74) *Attorney, Agent, or Firm* — William J. Clemens; Shumaker, Loop & Kendrick, LLP

(57) ABSTRACT

A monitoring unit, for monitoring an elevator system, includes a circuit assembly having a power supply unit for dispensing a grid-dependent first operating voltage and at least one processor-controlled monitoring module to actively and/or passively ascertain state data of the elevator system. An energy storage unit, that dispenses a grid-independent second operating voltage, and a first switching device supply the first operating voltage to the monitoring module during a normal operation and supply the second operating voltage to the monitoring module in the event of a power outage. A non-volatile data storage unit that stores a variable operating parameter and a second switching device deactivate parts of the circuit assembly. The monitoring module actuates the second switching device based on the stored operating parameter that has a first value before the monitoring unit is started and has a second value after the monitoring unit is started.

15 Claims, 4 Drawing Sheets

(51) Int. Cl.

| | |
|---|---|
| ***B66B 1/34*** | (2006.01) |
| ***B66B 5/02*** | (2006.01) |
| ***B66B 13/22*** | (2006.01) |

(56) References Cited

U.S. PATENT DOCUMENTS

| | | | | |
|---|---|---|---|---|
| 2013/0240301 | A1* | 9/2013 | Saarelainen | B66B 5/06 187/290 |
| 2014/0209415 | A1* | 7/2014 | Hall | H02J 9/062 187/290 |

FOREIGN PATENT DOCUMENTS

| | | | |
|---|---|---|---|
| CN | 1324323 | A | 11/2001 |
| CN | 201842552 | U | 5/2011 |
| EP | 2716588 | A1 | 4/2014 |
| JP | H03207282 | A | 9/1991 |
| WO | 03008316 | A1 | 1/2003 |
| WO | 2005000727 | A1 | 1/2005 |
| WO | 2014124779 | A1 | 8/2014 |

* cited by examiner

T
$s_{TX1}$

T
$s_{TX2}$ 2
1
10A
12
13
14
19
15
150 CPU
151 REG
ID0 / ID1
152 RAM
BP
FP
153 DAC
1541
154 P1
155 I/O
156 WD
157 T1
158 ADC
159 P2
op
ip
18
$s_{TX}$
$s_{RX}$
11A
31A
154 OUTPUT MODULE 156, 157 TIMERS 159 INPUT MODULE $s_{TX}$ $s_{RX}$ 2
1
10A
12
14
19
15
151
00000000000000008
16
161
00000000000000006
op
ip
18
17
11A
31A
$s_{TX}$
$s_{RX}$
17 LOCAL COMPARATOR 151, 161 REGISTERS

MONITORING UNIT FOR AN ELEVATOR SYSTEM, AND METHOD

FIELD

The invention relates to a monitoring unit for an elevator system and to a method for operating said monitoring unit.

BACKGROUND

An elevator system substantially comprises an elevator car, an elevator shaft, in which the elevator car moves, and a drive unit for moving the elevator car.

It is known from WO2005/000727A1 that elevator systems comprise a safety circuit in which a plurality of safety components, such as safety contacts and switches, are arranged in series connection. The contacts monitor whether a shaft door or the car door is open, for example. The elevator car can only be moved when the safety circuit and all of the safety contacts integrated therein are closed. Some of the safety elements are actuated by the doors. Other safety elements, such as an over travel switch, are actuated or triggered by the elevator car. The safety circuit is connected to the drive or the brake unit of an elevator system in order to interrupt the travel operation if the safety circuit is opened.

WO2005/000727A1 further discloses elevator systems that are equipped with a safety bus system instead of the above-mentioned safety circuit, which safety bus system typically comprises a control unit, a safety bus and one or more bus nodes.

Not only is the safety of individuals transported by the elevator system important, but so is the safety of individuals who are in the elevator shaft for maintenance purposes, for example.

WO2003008316A1 discloses that, for safety reasons, modern-day elevator systems are designed in such a way that a protective space in the form of a shaft pit is provided at the bottom of the shaft in order to ensure that maintenance personnel in the shaft are not endangered when the elevator car travels to the lowermost position in the shaft.

Additionally, a protective space is usually provided at the upper end of the shaft (called the shaft head) so that maintenance personnel carrying out maintenance on the roof of the car are not endangered when the car travels to the uppermost position in the shaft.

An elevator system having a protective space at the lower and upper end of the shaft is several meters longer than the actual floor height of the building in which the elevator operates. This applies to various types of elevator arrangements, such as cable elevators, hydraulic elevators and linear motor elevators.

In order to prevent or reduce the size of the above-mentioned protective spaces, the elevator system disclosed in WO2003008316A1 comprises, in addition to and independently of the usual sensors and control means that are provided for the normal operation of an elevator system, a detection device that detects whether an individual is in a critical zone of the shaft, in particular inside the shaft pit or the shaft head. Detection can be carried out by means of any sensors, e.g., photoelectric sensors. Said detection device is connected to the drive unit of the elevator system in such a way that the elevator system can be transferred into a specific operating state if an individual is in or about to enter the critical zone.

The detection device and the specific control device are designed in terms of safety to prevent the elevator car traveling into the critical zone under any circumstances, if an individual is therein. The design in terms of safety requires, for example, that important components be redundant, that important functions of the control device be executed in parallel with one another and the results thereof be compared, and that data be transmitted over parallel lines. The design of the elevator system in terms of safety is therefore associated with considerable complexity.

It should be further noted that elevator systems are typically constructed in a modular manner. Modules are therefore prefabricated and often stored intermediately for elevator systems that are to be produced in the future. Storing said modules often involves high complexity, as, for example, individual modules have to be checked and configured before use.

SUMMARY

The problem addressed by the present invention is therefore that of overcoming the disadvantages of the prior art and specifying an improved monitoring unit for an elevator system. Furthermore, a method for operating said monitoring unit is specified.

It should be possible to store the monitoring unit over a long period of time after manufacture and complete assembly without compromising the readiness thereof for use.

It should also be possible to remove the monitoring unit from storage after a long storage period and use said unit without further checking.

In particular, it should be prevented that the user has to configure the monitoring unit correspondingly for storage and, after removal from storage, for use in an elevator system.

Accordingly, it should also be prevented that the monitoring unit is provided with device parts that are to be manually actuated in order to configure the monitoring unit.

The complexity of storing and managing the prefabricated monitoring units for the elevator system should therefore be reduced to a minimum.

This problem is solved by a monitoring unit, which is used to monitor an elevator system, that comprises a circuit assembly which has a power supply unit that is provided for dispensing a grid-dependent first operating voltage and at least one processor-controlled first monitoring module that is used to actively and/or passively ascertain state data of the elevator system. The monitoring unit can, for example, read and store the present state data of the elevator system or sensor data. Alternatively, the monitoring unit can actively input test signals into the elevator system and register and evaluate response signals corresponding thereto. Preferably, a first monitoring module for emitting a test signal and a second monitoring module for receiving the response signal are provided.

According to the invention, the monitoring device comprises an energy storage unit, which is used to dispense a grid-independent second operating voltage, and a first switching device, by means of which the first operating voltage can be supplied to the at least one monitoring module during a normal operation and the second operating voltage can be supplied to the at least one first monitoring module in the event of a power outage. Furthermore, a non-volatile data storage unit, which is used to store a variable operating parameter, and a second switching device are provided, by means of which parts of the circuit assembly can be deactivated. The at least one first monitoring module is designed to actuate the second switching device on the basis of the stored operating parameter, which has a first value before the monitoring unit is started up and which has a second value after the monitoring unit has been started up.

The energy storage unit is an autonomous energy source, such as a battery, an accumulator, an ultracapacitor or a supercapacitor (supercap for short). It is essential that the energy storage unit be able to store electrical energy over a long period of time with virtually no loss. An autonomous energy storage unit may also be an accumulator that is powered by light energy, for example by means of solar cells.

By setting the operating parameter to the first or second value, the operating behavior of the monitoring device can be determined. The monitoring unit can therefore be fitted with an energy storage unit during manufacture and be put into storage without manually actuating a switch for deactivating the second operating voltage, optionally a battery voltage. As the consumption of energy from the energy storage unit is automatically restricted by the monitoring unit, the monitoring unit can be stored over a very long period of time without the energy storage unit having to be checked or replaced when the monitoring unit is removed from storage. In this way, managing the stored monitoring units is significantly simplified. A monitoring unit that is removed from an elevator system can also be provided again with the first value of the operating parameter and put back into storage without removing the energy storage unit.

It is particularly advantageous that the monitoring unit does not have to be provided with switching devices in order to protect the energy storage unit from premature discharge. Switching devices that can be actuated manually comprise a relatively high failure rate in comparison with semiconductor circuits, and therefore a significant improvement in this regard is also achieved using the solution according to the invention. Instead, the monitoring unit is provided with automatically controllable semiconductor components that do not show any signs of wear even after a long period of operation.

The monitoring module or monitoring modules provided on the monitoring unit may be formed advantageously by programmed microcontrollers that preferably comprise a processor unit, a volatile main memory, the non-voltage data storage unit and interface units. Furthermore, the microcontroller may comprise additional modules, such as timer units and transducer modules.

An operating program is preferably stored in the first monitoring module, according to which program the value of the operating parameter can be read out preferably periodically and the second switching device can be actuated on the basis of the read-out operating parameter.

The first value of the operating parameter is preferably an initialization value that is implanted in the monitoring unit during manufacture, for example. This first value may preferably also be implanted in a monitoring unit that is removed from an elevator system and, together with the energy storage unit, is put back into storage. The first initialization value may have, for example, the format of a network address, an invalid network address preferably being selected for the first initialization value.

The second value of the operating parameter is a value that is different from the first value. If an elevator system comprises a plurality of monitoring units and said units communicate with a computer and comprise corresponding communication addresses or network addresses, the corresponding network address can be stored as the second value of the operating parameter. The monitoring unit can be programmed correspondingly, i.e., the first or second value of the operating parameter can be implanted, by a connected computer.

Preferably, this address is implanted in all of the intelligent modules, i.e., in all of the monitoring modules, that are provided on the monitoring unit. In addition to the main address, individual subaddresses can be allocated to the monitoring modules for individually addressing said modules.

If the above-mentioned operating parameter is tracked in each monitoring module and corresponding operating programs are available for this purpose, each of the monitoring modules can monitor this operating parameter and carry out appropriate deactivation processes. For this purpose, a second switching device may be associated with each monitoring module, which device is actuated when the first value of the operating parameter is present in order to completely or partially deactivate the relevant monitoring module if the grid-dependent first operating voltage fails.

If the monitoring module is not completely deactivated, it can advantageously be provided that said module is repeatedly put into a sleep mode and, after a period of, for example, a few seconds or minutes, is transferred into a complete or partial operating state in order to carry out control measures, such as checking the value of the operating parameter. For this purpose, the monitoring module comprises a timer unit that counts one sleep period at a time. Monitoring units designed in this way are therefore also active for a short time during storage, but only require minimal energy for a very short period of time. The operation life of the energy storage unit is only marginally reduced by this energy consumption.

The second switching device can advantageously be integrated in the monitoring module. Alternatively, the second switching device may also be constructed so as to be discrete. For example, the second switching device comprises a switching transistor that is controlled by one of the monitoring modules.

The circuit arrangement can therefore be partially disconnected from the power supply in order to save energy. Furthermore, complete disconnection from the energy storage unit can be provided by the second switching device, e.g., a switching transistor, completely disconnecting the energy storage unit from the circuit arrangement. If the first value of the operating parameter is present, the second switching device is opened and interrupts, for example, a connecting line of the energy storage unit. If the second value of the operating parameter is present, the second switching device is closed, in contrast, such that the energy storage unit is connected to the circuit arrangement or to the change-over switch that connects either the first or the second operating voltage to the monitoring modules.

The monitoring units can monitor the state of at least one part of the elevator system and can determine and register corresponding state data and transmit said data to a central computer.

The elevator system comprises a drive unit by means of which an elevator car arranged in an elevator shaft can be moved and which is controlled in a safe manner by a control device in such a way, for example, that a) the elevator car can be moved to at least two access points of the elevator shaft in normal operation, at which points doors are provided, which are controlled by the control device and with at least one of which a door lock is associated, by means of which lock the associated door can be unlocked and opened even in the case of a power outage; and b) the elevator car does not move or moves only to a limited extent if an individual is in the elevator shaft.

A monitoring unit and a monitoring sensor are associated with at least one of the doors, by means of which sensor changes in state, such as the door being unlocked or opened, are detected. When the elevator system is entirely or partially out of order, the monitoring unit equipped with an energy storage unit can be switched into autonomous operation and recorded during the autonomous operation on the basis of state data corresponding to the monitoring sensor. This state data is read out from all the monitoring units and evaluated by a safeguard unit or a superordinate computer after the elevator system has been started up, whereupon the elevator system is prevented from being put into the normal operation if a change in state of one of the monitored doors has been detected.

This makes it possible to safely monitor an individual's access into the elevator shaft and prevent the transition of the elevator system into normal operation if an event has been detected that indicates that an individual may have entered the elevator shaft. As soon as a critical change in state is detected or recognized by the safeguard unit, this is signaled to a control computer, for example. Alternatively, the control unit may intervene directly in the elevator system and, for example, interrupt the power supply or put the drive unit out of operation. The safeguard unit may, for example, be integrated as a software module in the control computer or be formed as a separate module that interacts with the control computer or other parts of the elevator system.

The safeguard unit can thus communicate with the installed monitoring units and can also implant the communication address or network address in said units as the operating parameter when starting up the units. If one of the monitoring units is removed from the elevator system, in contrast, the safeguard unit can reset the operating parameter to the first value, which was assigned during manufacture.

DESCRIPTION OF THE DRAWINGS

The device according to the invention is described by way of example in the following in preferred embodiments with reference to the drawings, in which.

DETAILED DESCRIPTION

Figure 1:
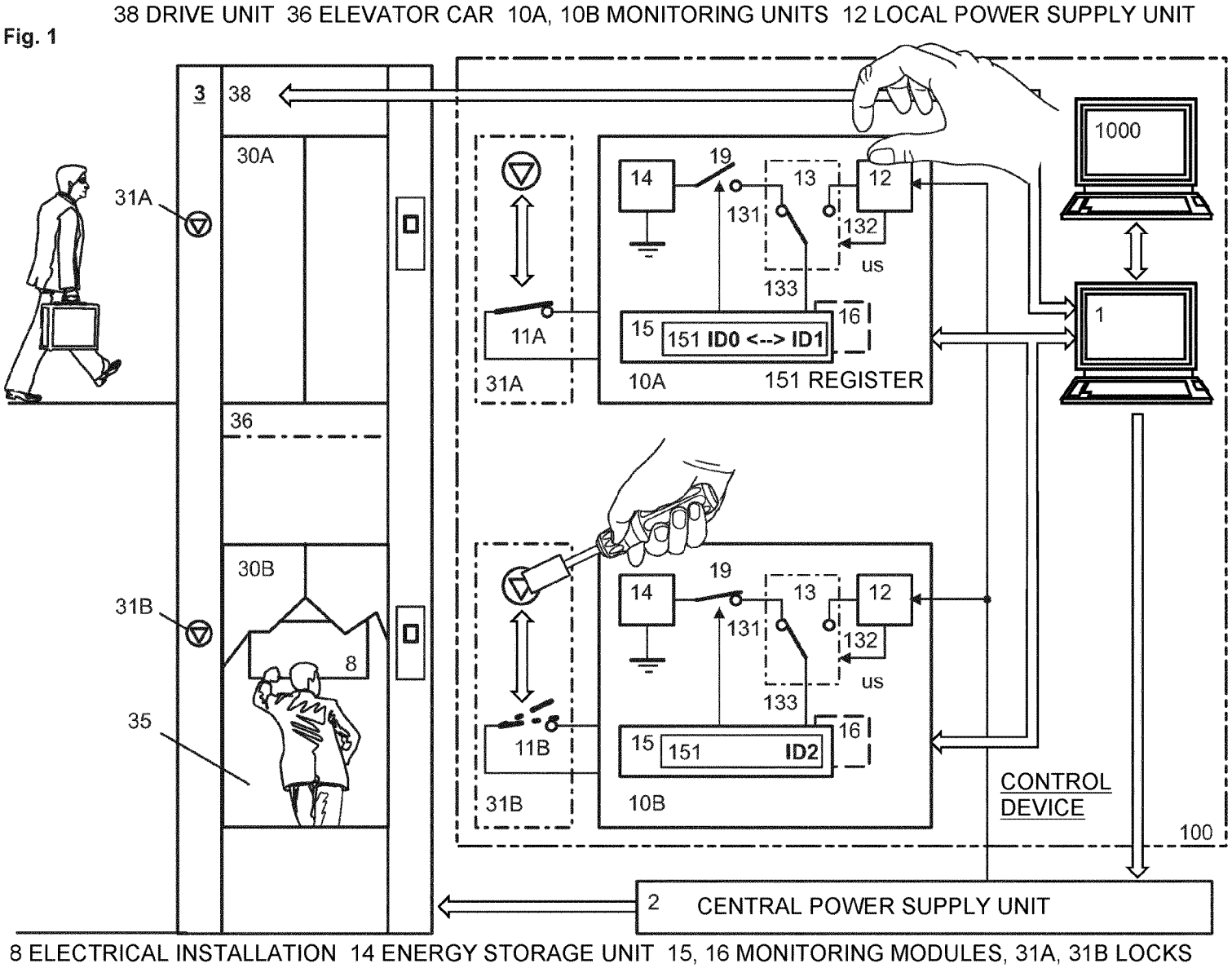
FIG. 1 shows an elevator system 3 comprising a drive unit 38, by means of which an elevator cab 36 arranged in an elevator shaft 35 can be moved between two elevator doors 30A, 30B, and comprising a control device 100 that has a safety unit 1 for monitoring the elevator system 3, which safety unit is connected to monitoring units 10A, 10B according to the invention, by means of which monitoring units a locking mechanism 31A, 31B of an associated elevator door 30A, 30B respectively is monitored and which units can adopt a specific operating mode M1, M2 or M3 according to FIG. 2*a* or 2*b*, on the basis of an operating parameter ID0, ID1, ID2.

FIG. 1 shows an elevator system 3 comprising a drive unit 38, by means of which an elevator car 36 arranged in an elevator shaft 35 can be moved between two elevator doors 30A, 30B. The elevator system 3, which is powered by a central power supply unit 2, is equipped with a control device 100, by means of which the elevator system 3, in particular the drive unit 38, can be controlled. The control device 100 comprises a safeguard unit 1 for monitoring the elevator system 3, which unit is connected or can be connected to monitoring units 10A, 10B, by means of which a lock 31A, 31B of an associated elevator door 30A, 30B respectively, or a monitoring sensor 11A or 11B coupled thereto, can be monitored. The monitoring units 10A, 10B are, e.g., populated circuit boards.

In the present embodiment, the safeguard unit 1 is a stand-alone computer system that communicates with a system computer 1000. However, the safeguard unit 1 may also be integrated in the system computer 1000 as a software module or hardware module. The safeguard unit 1 can, as shown in FIG. 1, intervene directly in the elevator system 3 and, for example, control or turn off the power supply 2 or the drive unit 38. Alternatively, the safeguard unit 1 may be connected only to the system computer 1000, which in turn carries out the safeguarded control of the elevator system 3 by taking into account state data that has been determined on the basis of the monitoring units 10A, 10B.

The safeguard unit 1 and/or the system computer 1000 may also be connected to external computer units, e.g., a host computer, wirelessly or via a wired connection.

In the present embodiment, the monitoring sensors 11A, 11B are formed as switching contacts that are each mechanically coupled to a door lock 31A, 31B that can be actuated by maintenance personnel by means of a tool, as shown in FIG. 1 for the switching contact 11B. During a power outage or deactivation of the power supply, the maintenance personnel can thus actuate a door lock 31A, 31B, manually open an elevator door 30A, 30B and enter the elevator shaft 35.

FIG. 1 shows that after a power outage or deactivation, the lower elevator door 31B has been opened and a maintenance technician has entered the elevator shaft 35 in order to check an electrical installation 8 that, for example, could have caused the power failure. The maintenance technician stands on the shaft floor in a shaft pit that has only a shallow depth. In this situation, the elevator system 3 must not be operated. In the upper level, a building resident moves towards the first elevator door 30A, behind which is the elevator car 36. If the elevator system 3 is supplied with power again in this moment and is put into normal operation, the building resident can enter the elevator car 36 and put it into motion. This is prevented by the switching contacts 11A, 11B being monitored and transition into normal operation being prevented if one of the switching contacts 11A, 11B has been actuated. So that this monitoring can be carried out even after a power outage, the monitoring units 10A, 10B are equipped with an energy storage unit 14 and can be switched into autonomous operation if the elevator system 3 has been completely or partially shut down or if there is a power outage.

FIG. 1 further shows that the two identically formed monitoring units 10A, 10B each comprise a local power supply unit 12 and an energy storage unit 14, both of which can be connected to a first and optionally a second monitoring module 15, 16 via a controllable switch unit 13, e.g., a voltage-controlled relay. Either the power supply unit 12 is connected to the at least one monitoring module 15 via the contacts 132, 133 of the switch unit 13 or the energy storage unit 14 is connected to the at least one monitoring module 15 via the contacts 131, 133 of the switch unit 13. The at least one monitoring module 15 is therefore supplied either with a grid-dependent first operating voltage from the power supply unit 12 or with a grid-independent second operating voltage from the energy storage unit 14.

The switch unit 13 is supplied with a switching voltage us by the power supply unit 12, by means of which switching voltage the switch unit 13 is activated and the power supply unit 12 is connected to the monitoring modules 15, 16 as soon as the first operating voltage is present. If there is a power outage, the switching voltage us is dispensed with and the switch unit 13 returns into the rest position, in which the energy storage unit 14 is connected to the monitoring modules 15, 16 if the switch 19 shown is closed. Due to the identical configuration of the monitoring units 10A, 10B, reference is made in the following only to the first monitoring unit 10A, which comprises at least the process-controlled first monitoring module 15.

In the rest position of the switch unit 13, the energy storage unit 14, which is connected on one side to ground, remains constantly connected to the circuit assembly of the monitoring unit 10A when the switch 19 is closed. If the monitoring unit 10A is removed from the elevator system 3 in this state, the energy storage unit 14 would remain permanently connected to the relevant circuit assembly. Said energy storage unit would also remain permanently connected to the circuit assembly after the monitoring unit 10A is manufactured and the energy storage unit 14 is inserted. This insertion or removal of the monitoring unit 10A is shown symbolically in FIG. 1 by a hand. If the monitoring unit 10A is put into storage after manufacture and the circuit assembly is permanently powered by the energy storage unit 14, said energy storage unit would discharge at least in part during a long storage period.

According to the invention, it is therefore provided that the monitoring unit 10A comprising an incorporated energy storage unit 14 can be put into storage and the consumption of energy from the energy storage unit 14 is automatically interrupted or reduced during this period by actuating the switch 19 shown by way of example or a switching unit corresponding therewith. It is therefore not necessary for a user to intervene manually in order to prepare the monitoring unit 10A for storage or to configure said unit after storage.

In the embodiment in FIG. 1, the switch 19 is provided in order to limit energy consumption, which switch can be actuated by the first monitoring module 15. The switch 19 is actuated on the basis of a variable operating parameter that is stored in a non-volatile data storage unit 151, preferably in a register of the monitoring unit 15, and is periodically checked by the monitoring module 15. Said variable operating parameter has a first value before the monitoring unit 10A is started up and a second value after the monitoring unit 10A has been started up. If the first value is present, the switch 19 is opened. If the second value is present, the switch 19 is closed.

In order to prepare storage of the monitoring unit 10A, i.e., during manufacture or before removal of the monitoring unit 10A from the elevator system 3, the first value of the operating parameter is stored in the data storage unit 151. After the monitoring unit 10A is removed from storage and installed in the elevator system 3, this first value is overwritten by the second value. This can be carried out by a superordinate computer, e.g., the safeguard unit 1, or by the monitoring module 15 itself. If the monitoring module 15 detects, for example, that installation in the elevator system 3 has occurred and the grid-dependent first operating voltage is present, the first value of the operating parameter can be overwritten by the second value, the presence of which causes the switch 19 to close and remain closed if the grid-dependent first operating voltage drops.

The first value of the operating parameter is preferably an initialization value ID0, which is implanted in all the monitoring units 10A during production. The second value ID1 of the operating parameter (or ID2 for the second monitoring unit 10B) is preferably a network address associated with the monitoring unit 10A that is assigned inside the elevator system only once and is unambiguous in this area.

I.e., the switch 19 is automatically closed as a result of the integration of the monitoring unit 10A into the elevator system 3. The switch 19 is a switching transistor, for example, that is discretely arranged on the monitoring unit 10A or is integrated in the monitoring module 15. If the switch 19 is integrated in the monitoring module 15, parts of the monitoring module 15 that are not necessary for reactivating the monitoring module 15 are preferably deactivated. If a plurality of monitoring modules 15, 16 are provided, the solution according to the invention is implemented optionally identically in both monitoring modules 15, 16. In principle, the monitoring unit 10A may also comprise a plurality of switches 19, by means of which the various regions of the circuit arrangement are supplied with power. The second switching device according to the invention therefore comprises one or more discrete or integrated switching transistors.

Figure 2B:
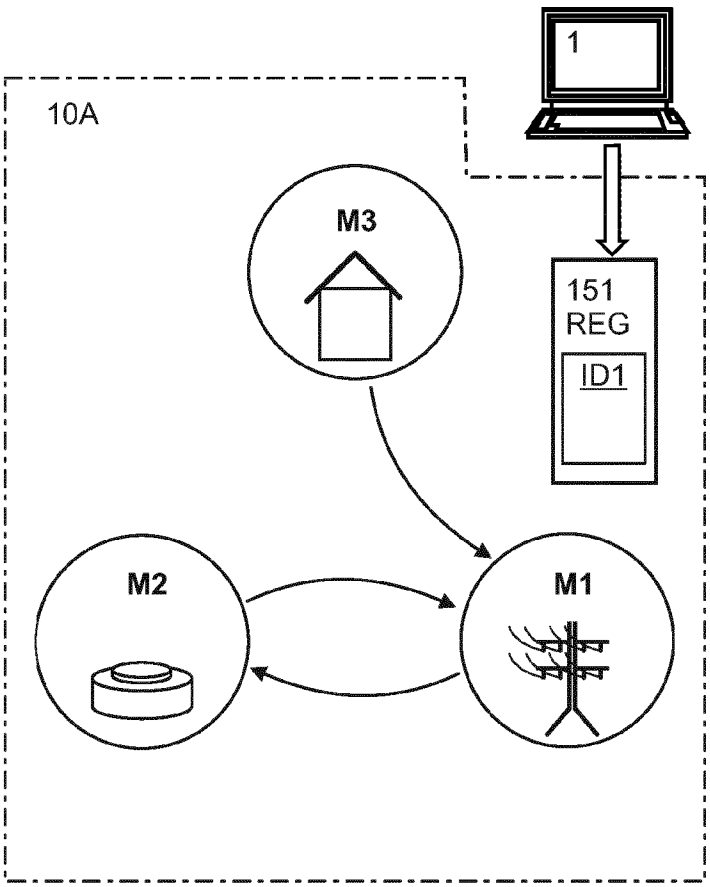
FIG. 2*b* shows the first monitoring unit 10A from FIG. 1, which can switch between two operating states M1 and M2, shown symbolically, on the basis of the set operating parameter ID1 and the presence of a grid-dependent first operating voltage.
Figure 2A:
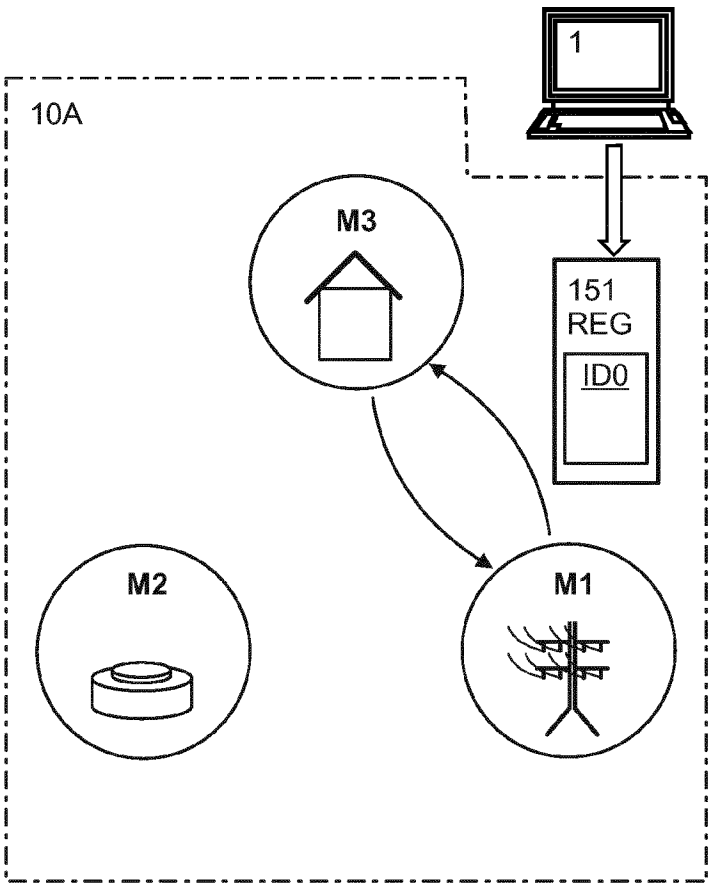
FIG. 2*a* shows the first monitoring unit 10A from FIG. 1, which switches between two operating states M1 and M3, shown symbolically, on the basis of the set operating parameter ID0 and the presence of a grid-dependent first operating voltage.

FIG. 2*a* shows the first monitoring unit 10A from FIG. 1, which monitoring unit switches between two operating modes, a grid mode M1 and a deep sleep mode M3, shown symbolically, on the basis of the set operating parameter ID0 and the presence of a grid-dependent operating voltage. If the grid-dependent first operating voltage fails, the first monitoring unit 10A is always in deep sleep mode M3, in which no energy or very little energy from the energy storage unit 14 is required. In said deep sleep mode M3, in which the switch 19 is open in the case of the monitoring unit from FIG. 1, the monitoring unit 10A can be stored for a long period of time without the energy storage unit 14 being discharged. If the monitoring unit 10A is installed in the elevator system in this state and the operating parameter is left on the first value ID0, the monitoring unit 10A switches into grid mode M1, in which said unit can perform all functions, when the grid-dependent first operating voltage is present. The monitoring module 15 tests the operating parameter ID0 and leaves the switch 19 open. As soon as the grid-dependent first operating voltage fails, the monitoring unit 10A switches back into deep sleep mode M3, in which the monitoring unit 10A does not perform a function for monitoring the elevator system 3.

FIG. 2*b* shows the first monitoring system 10A from FIG. 1 after installation in the elevator system 3 and setting the operating parameter to the second value ID1. After the monitoring unit 10A is removed from storage and installed in the elevator system 3, the state of the monitoring unit 10A has switched from deep sleep mode M3 to grid mode M1. In grid mode M1, the operating parameter is set to the second value ID1 either automatically by the monitoring unit 10A or by the safeguard unit 1. The monitoring module 15 then determines that the second value ID1 is present and closes the switch 19. If the grid-dependent first operating voltage now fails, the first monitoring unit 10A changes into battery mode M2, in which the energy storage unit 14 dispenses the grid-independent second operating voltage to the monitoring module 15. When the grid-dependent operating voltage is activated and deactivated, the first monitoring unit 10A switches between grid mode M1 and battery mode M2. If the monitoring unit 10A in this configuration is removed from the elevator system and the operating parameter is not changed, the monitoring unit 10A remains in battery mode M2. When the monitoring unit 10A is removed from the elevator system, the switch 19 is thus first opened by changing the operating parameter to the first value ID0, such that the monitoring unit 10A reverts into deep sleep mode M3 and can be put into storage after the grid-dependent first operating voltage is deactivated.

In FIGS. 2*a* and 2*b*, corresponding symbols, a power grid, an energy storage unit and a storage facility, are associated with the operating states M1, M2 and M3, which symbols illustrate the changes in state.

As stated above, an autonomous energy storage unit 14 may also be an accumulator that is powered by light energy, for example by means of solar cells. In a preferred embodiment, any modules of an electrical system, such as circuit boards, can therefore also be provided with said autonomous energy storage unit 14. If these modules are put into storage in deep sleep mode M3, it is provided for said modules to be exposed to artificial or natural light and the accumulator 14 to therefore be regularly charged.

In preferred embodiments, the solution according to the invention can also be designed to be particularly advantageous for automatic storage management and storage control. In this case, it can be provided for the monitoring units 10A, 10B, or any desired modules, to switch preferably regularly from the deep sleep mode M3 into a report mode M4 and wirelessly transmit status messages or status reports to a storage computer L1. For example, it is provided for the monitoring units 10A, 10B to switch into report mode M4 and report their status at intervals that can preferably be selected, e.g., weekly or monthly. This status report can contain the report on a test that has previously been carried out. Additionally, the monitoring units 10A, 10B revert back into deep sleep mode M3, optionally after confirmation of receipt from the storage computer L1. If all of the modules in storage are formed according to the invention, an inventory list for the entire storage facility can therefore be automatically created. Said inventory list can be compared with the updated stock ledger. If a status report reports the defect of a module, said module can be removed from storage and repaired. Due to the large time intervals, the energy required to operate the modules in report mode M4 is virtually negligible.

In order to communicate with the storage computer L1 and optionally to carry out tests internally, the corresponding switching units are activated and provided with the second operating voltage. Of course, an interface is provided for wireless communication with a sending unit and preferably a receiving unit. Furthermore, a communication protocol can be implemented that allocates each module a time slot for transmission. The status reports can therefore be delivered at time intervals, controlled by a timer. Alternatively, time frames can be opened at time intervals, in which time frames the monitoring units 10A or any desired modules can be addressed and queried. As mentioned, time intervals are preferably provided in the range of days, weeks or months.

The monitoring units 10A and 10B according to the invention can perform any monitoring functions in an elevator system 3 that is in operation or is inactive due to a power outage. It will be shown in the following, by way of example, that the access point to the elevator shaft 35 can be monitored by means of the monitoring units 10A and 10B.

For this purpose, a monitoring signal is generated in each monitoring unit 10A, 10B from FIG. 1, which signal is carried back to an input of the monitoring unit 10A, 10B via an output port of the monitoring unit 10A, 10B and the corresponding switching contact 11A, 11B and is evaluated in a first monitoring module 15 and/or in a second monitoring module 16. The first monitoring unit 10A therefore actively feeds a monitoring signal into the elevator system 3 that is to be monitored and checks whether relevant changes to said monitoring signal occur. Alternatively, the first monitoring unit 10A could also receive passive signals that are transmitted from the elevator system 3.

At least during autonomous operation of the monitoring units 10A, 10B or in battery mode M2 during a power outage, the monitoring sensors or the switching contacts 11A, 11B are monitored in order to record a change in state or an actuation of the relevant door lock 31A, 31B. Monitoring is preferably also carried out in grid mode M1. If actuation of one of the switching contacts 11A, 11B is detected while in battery mode M2, the elevator system is preferably deactivated.

After the power outage has ended, the elevator system 3 is powered again with energy from the central power supply unit 2. An operating voltage is again supplied to the local power supply units 12 in the monitoring units 10A, 10B, which in turn subsequently generate the switching voltage us and activate the switch unit 13. The state data collected in the monitoring units 10A, 10B or status messages already derived therefrom can then subsequently be retrieved by the safeguard unit 1 and further processed. The safeguard unit 1 determines, on the basis of the state data from the second monitoring unit 10B, that the associated door lock 31B has been actuated and that an individual may be in the elevator shaft 35 (see FIG. 1). The safeguard unit 1 therefore prevents the elevator system 3 from being started up, by directly intervening in the elevator system 3, e.g., by deactivating the power supply 2, or by notifying a superordinate computer or the system computer 1000, which in turn prevents the elevator system 3 from being started up.

Figures 3A, 3B, 3C:
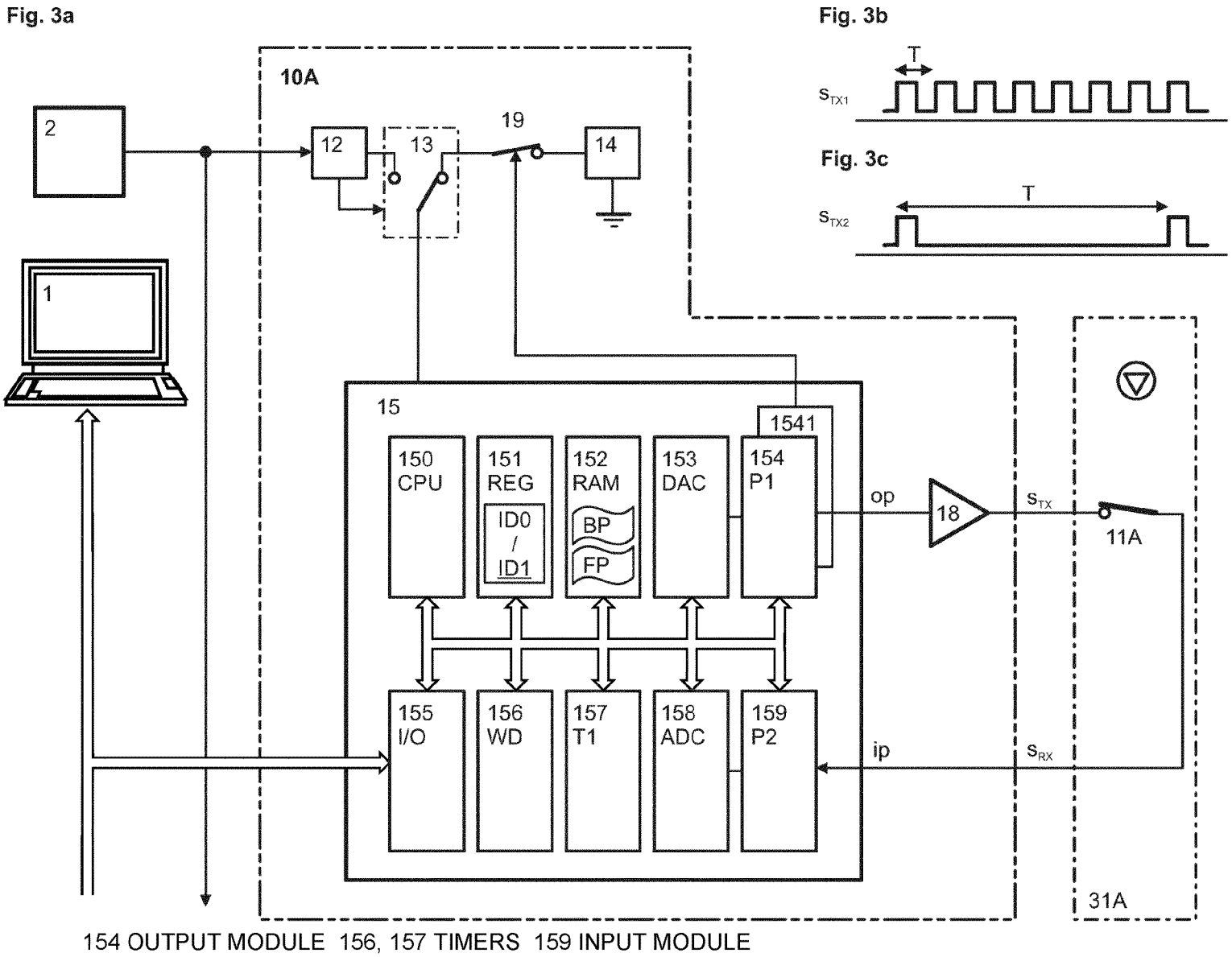
FIG. 3*a* shows the first monitoring unit 10A from FIG. 1, which only comprises one process-controlled monitoring module 15 that transmits a monitoring signal $s_{TX}$ from an output port op to an input port ip of the monitoring module 15 via a switching contact 11A that is associated with the door lock 31A of the first elevator door 30A.
FIG. 3*b* shows the monitoring signal $s_{TX1}$ emitted at the output port op by way of example as a pulse sequence having a selected pulse duty cycle of 50%.
FIG. 3*c* shows the monitoring signal $s_{TX2}$ emitted at the output port op by way of example as a pulse sequence having a pulse duty cycle of approximately 7% and a cycle duration T increased by a factor of 7.

FIG. 3*a* shows the first monitoring unit 10A from FIG. 1, which only comprises one processor-controlled first monitoring module 15 that transmits a monitoring signal $s_{TX}$ from an output port op to an input port ip via the switching contact 11A that is associated with the door lock 31A of the first elevator door 30A and is mechanically coupled thereto.

The monitoring module 15 is, for example, a microcontroller having lowest power consumption in the operating state (preferably <100 μA) and in the idle state (preferably <500 nA), short delay times when transferring from the idle state into the operating state (preferably <1 μs), and all of the essential functions for signal processing. For example, a microcontroller is used, as is described in the documentation "MSP Low-Power Microcontrollers" from Texas Instruments Incorporated, dated 2015.

The monitoring module 15 shown in FIG. 3*a* is a microcontroller having a CPU 150, one or more registers REG 151, a main memory RAM 152, an optionally provided digital/analog converter DAC 153, at least one output module P1 154, an interface component I/O 155, a watchdog timer WD 156, at least one additional timer T1 157, an analog/digital converter ADC 158, and at least one input module P2 159. The individual modules are or can be connected to one another via a system bus and to the safeguard unit 1 via the interface component 155. The second monitoring module 16 from FIG. 1 is preferably configured identically to the first monitoring module 15, but is provided with correspondingly adapted software.

An operating program BP and preferably a filter program FP are stored in the main memory 152. The values of the operating parameter can be read out from the data storage unit 151 by means of the operating program BP. The switch or switching transistor 19 is controlled by the output port 1541 on the basis of the read-out value ID0 or ID1. In the present state, the second value ID1 is stored, in the presence of which value the switch 19 is closed and the monitoring unit 10A goes into battery mode M2 as soon as the grid-dependent first operating voltage fails. The state of the switch unit 13 shows that the power has actually failed and the monitoring module 15 is being supplied with power from the energy storage unit 14.

Via an additional output port op and an amplifier 18, a monitoring signal $s_{TX}$, which is generated in the monitoring module 15, can be transmitted to an input port ip of the monitoring module 15 via the switching contact 11A.

FIG. 3*b* shows, by way of example, a monitoring signal $s_{TX1}$, emitted at the output port, from FIG. 2*a* in the state M1 or M2 as a pulse sequence having a pulse duty cycle of 50%. A comparison of the monitoring signal $s_{TX}$ emitted at the output port op with the monitoring signal $s_{RX}$ received at the input port indicates whether the switching contact 11A has been opened during the transmission. If some of the pulses are not transmitted, a change in state of the switching contact 11A and thus a possible opening of the elevator door 30A is recorded and reported. For example, the number of pulses sent and the number of pulses received are stored in the register 151 and are compared with one another before the elevator system 3 is started up, in order to detect a door being opened.

FIG. 3*c* shows a monitoring signal $s_{TX2}$ from FIG. 2*a*, emitted at the output port op, in the state M1 or M2 as a pulse sequence having a pulse duty cycle of approximately 7% and a cycle duration T that is higher by a factor of 7 in comparison with the signal from FIG. 2*b*. By reducing the pulse duty cycle and increasing the cycle duration, the energy required can be significantly reduced.

Between two pulses of the monitoring signals $s_{TX1}$ and $s_{TX2}$, the monitoring module 15 can also be put into an idle state in which the power consumption is minimal and only circuit parts that are necessary for the transition from the idle state into the operating state are operated. For example, external stimuli or wake-up signals are monitored. Advantageously, a wake-up signal may also be generated inside the monitoring module 15 by a timer 156, 157, for example. Said sleep mode differs from deep sleep mode M3 in that more circuit modules remain in an active mode. For example, the watchdog 156 that is not required in deep sleep mode M3 remains active.

Figures 4A, 4B, 4C:
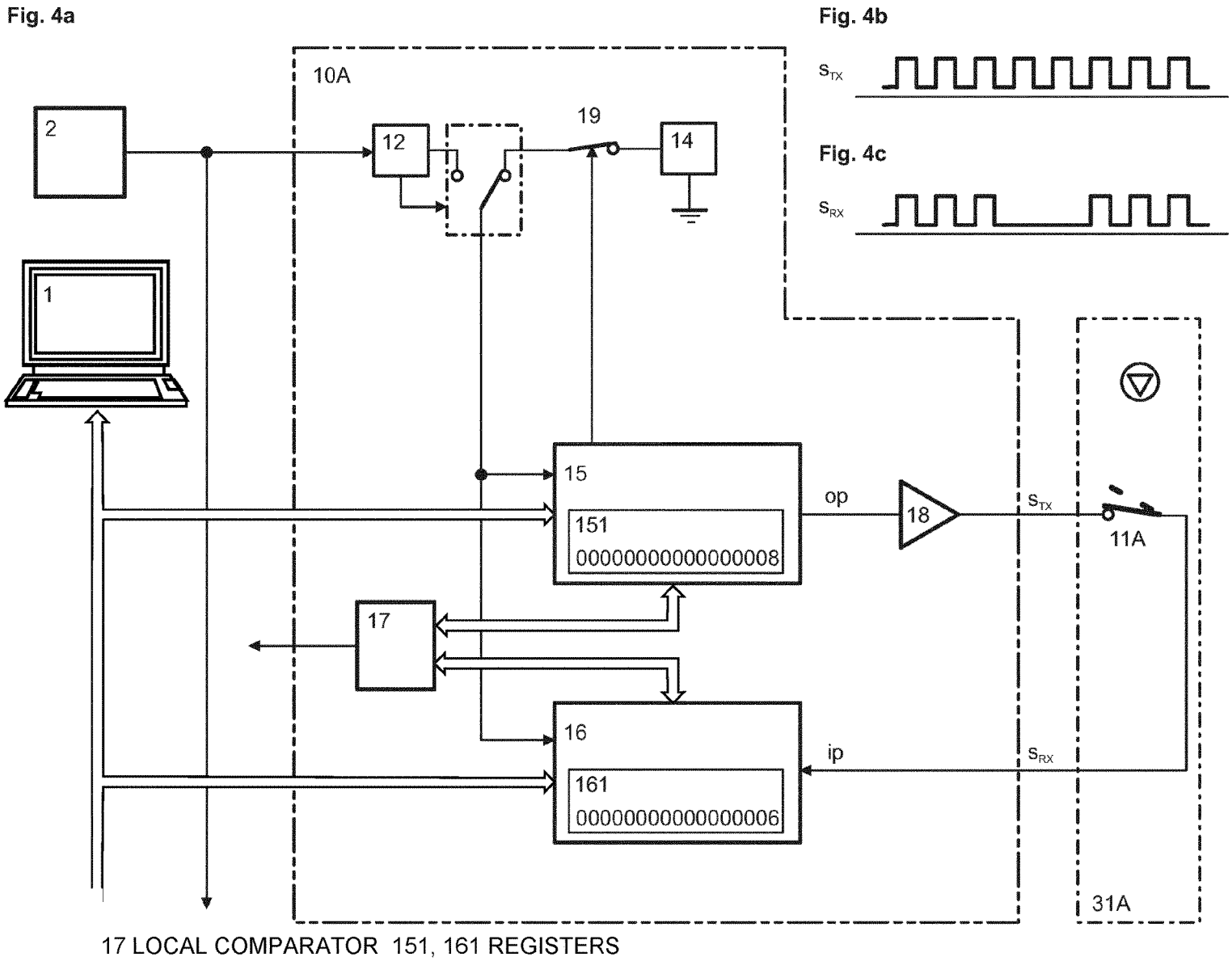
FIG. 4*a* shows the first monitoring unit from FIG. 1 in a further preferred embodiment, comprising the first monitoring module 15, which transmits a monitoring signal $s_{TX}$ from an output port op to an input port ip of a second process-controlled monitoring module 16 via a switching contact 11A.
FIG. 4*b* shows the monitoring signal $s_{TX}$ from FIG. 3*b* by way of example as a pulse sequence having a pulse duty cycle of 50% before transmission via the switching contact 11A.
FIG. 4*c* shows the monitoring signal $s_{RX}$ from FIG. 3*b* after transmission via the switching contact 11A, which opened during the duration of two pulses that were not recorded in the register 161 of the second monitoring module 16.

FIG. 4*a* shows the first monitoring unit from FIG. 3*a* in battery mode M2, comprising the first monitoring module 15, which transmits a monitoring signal $s_{TX}$ from the output port op to the input port ip of a second process-controlled monitoring module 16 via the switching contact 11A. Both of the monitoring modules 15, 16 are powered by the energy storage unit 14. In the first monitoring module 15, the number of pulses sent is recorded in the register 151. In the second monitoring module 16, the number of pulses received is recorded in a register 161.

FIG. 4*b* shows the monitoring signal $s_{TX}$ from FIG. 4*a* as a pulse sequence having a pulse duty cycle of 50% before transmission via the switching contact 11A.

FIG. 4*c* shows the monitoring signal $s_{RX}$ from FIG. 4*a* after transmission via the switching contact 11A, which opened during the transmission of two pulses that were not recorded in the register 161 of the second monitoring module 16. The change in state of the switching contact 11A can be established by comparing the contents of the registers 151, 161. The comparison of the contents of the registers 151, 161 can be carried out in one of the monitoring modules 15, 16, in a local comparator 17, or centrally in the safeguard unit 1, which reads out all the register contents from the monitoring units 10A, 10B.

In this embodiment of the monitoring units 10A, both the monitoring units 15, 16 transition into deep sleep mode M3. For this purpose, the operating parameter can be stored and monitored in each of the monitoring modules 15, 16. However, the operating states M1, M2 and M3 can also be centrally controlled only by one of the process-controlled monitoring modules 15, 16.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A monitoring unit for monitoring an elevator system, the elevator system including a drive unit moving an elevator car in an elevator shaft, the monitoring unit having a circuit assembly comprising:

a power supply unit for dispensing a grid-dependent first operating voltage;

at least one processor-controlled monitoring module that at least one of actively and passively ascertains state data of the elevator system;

an energy storage unit for dispensing a grid-independent second operating voltage;

a first switching device for supplying the first operating voltage to the at least one monitoring module during a normal operation of the elevator system and supplying the second operating voltage to the at least one monitoring module in response to a power outage of the elevator system;

a non-volatile data storage unit storing a variable operating parameter; and a second switching device for deactivating parts of the circuit assembly, wherein the at least one monitoring module actuates the second switching device based on the stored operating parameter, the stored operating parameter having a value being a first value before the monitoring unit is started up and a second value after the monitoring unit is started up.

2. The monitoring unit according to claim 1 wherein the at least one monitoring module is a microcontroller that includes at least one processor unit, a volatile main memory, the non-volatile data storage unit and interface units connected together.

3. The monitoring unit according to claim 1 including an operating program stored in the at least one monitoring module and run to read out the value of the operating parameter periodically and wherein the second switching device is actuated based on the value of the operating parameter.

4. The monitoring unit according to claim 1 wherein the first value of the operating parameter is an initialization value implanted in the monitoring unit during production of the monitoring unit, and the second value of the operating parameter is a network address that is associated with the monitoring unit.

5. The monitoring unit according to claim 1 wherein the second switching device is integrated in the at least one monitoring module or is contained discretely in the circuit assembly.

6. The monitoring unit according to claim 1 wherein the second switching device includes at least one switching transistor controlled by the at least one monitoring module.

7. The monitoring unit according to claim 1 wherein when the first value of the operating parameter is present, the second switching device is open and disconnects the energy storage unit from the circuit assembly, and wherein the second switching device is closed when the second value of the operating parameter is present and connects the energy storage unit to the circuit assembly.

8. The monitoring unit according to claim 1 wherein the monitoring unit is connected to a monitoring sensor for detecting changes in a state of the elevator system including whether an elevator door is at least one of unlocked and opened.

9. A method for operating a monitoring unit used to monitor an elevator system, the elevator system including a drive unit moving an elevator car in an elevator shaft, the monitoring unit having a circuit assembly including a power supply unit for dispensing a grid-dependent first operating voltage and at least one processor-controlled monitoring module that at least one of actively and passively ascertains state data of the elevator system, comprising the steps of:

providing an energy storage unit dispensing a grid-independent second operating voltage, and a first switching device for supplying the first operating voltage to the at least one monitoring module during a normal operation of the elevator system and supplying the second operating voltage to the at least one monitoring module in response to a power outage of the elevator system;

providing a non-volatile data storage unit and storing in the data storage unit a variable operating parameter;

providing a second switching device for deactivating parts of the circuit assembly;

setting the operating parameter to a first value before the monitoring unit is started up and setting the operating parameter to a second value after the monitoring unit has been started up; and wherein the at least one monitoring module actuates the second switching device based on the stored operating parameter.

10. The method according to claim 9 wherein the at least one monitoring module is a microcontroller that includes at least one processor unit, a volatile main memory, the data storage unit and interface units connected together; and including the steps of storing an operating program in the main memory, running the operating program to read out a value of the operating parameter periodically, and actuating the second switching device based on the read-out value of the operating parameter.

11. The method according to claim 10 wherein when the first value of the operating parameter is present and the first operating voltage is deactivated, the monitoring unit is transferred into a deep sleep mode whereby at least parts of the circuit assembly are disconnected from the energy storage unit, and when the second value of the operating parameter is present and the first operating voltage is deactivated, the monitoring unit is transferred into a battery mode by connecting the second operating voltage from the energy storage unit to the circuit assembly.

12. The method according to claim 11 wherein the first value of the operating parameter is an initialization value that is implanted in the monitoring unit during production or during removal from the elevator system, and wherein the second value of the operating parameter is a network address that is associated with the monitoring unit and is implanted in the monitoring unit after installation in the elevator system by an associated computer.

13. The method according to claim 11 characterized wherein the at least one monitoring module includes at least one timer that repeatedly puts the monitoring unit into a sleep mode when the monitoring unit is in the deep sleep mode and the battery mode and after a predetermined period transfers the monitoring unit into a complete or partial operating state to carry out control measures, and the at least one timer transitions the monitoring unit from the deep sleep mode into a report mode to deliver status reports.

14. The method according to claim 9 wherein the second switching device is arranged inside the at least one monitoring module and deactivates at least part of an electric circuit inside the at least one monitoring module when the first value of the operating parameter and the second operating voltage are present.

15. The method according to claim 9 including connecting the monitoring unit to a monitoring sensor that detects changes in a state of the elevator system, including at least one of an elevator door being unlocked or opened, during the normal operation and during the power outage of the elevator system.

* * * * *